United States Patent [19]

Genev et al.

[11] Patent Number: 4,570,864

[45] Date of Patent: Feb. 18, 1986

[54] DISC CRUSHER

[75] Inventors: Ivan V. Genev; Stefan T. Bagarov; Evtim V. Genev; Boris Y. Drakaliiski; Marin P. Marinov; Kosta Y. Kirilov, all of Sofia, Bulgaria

[73] Assignee: ISO "Metalurgkomplekt", Sofia, Bulgaria

[21] Appl. No.: 484,647

[22] Filed: Apr. 13, 1983

[51] Int. Cl.[4] ..... B02C 19/00

[52] U.S. Cl. ..... 241/252; 241/248

[58] Field of Search ..... 241/261.1, 248, 249, 241/251, 252, 253, 257 R, 254, 258

[56] References Cited

U.S. PATENT DOCUMENTS

| | | | |
|---|---|---|---|
| 1,494,684 | 5/1924 | Gross | 241/248 |
| 4,199,113 | 4/1980 | Genev | 241/252 X |
| 4,203,558 | 5/1980 | Schnitzer | 241/248 X |

FOREIGN PATENT DOCUMENTS

| | | | |
|---|---|---|---|
| 790632 | 11/1935 | France | 241/252 |
| 753460 | 8/1980 | U.S.S.R. | 241/252 |

*Primary Examiner*—Mark Rosenbaum

[57] ABSTRACT

Disc crusher having a housing fitted on a supporting frame and closed by a cover bearing an input tube, within the housing there being fitted a rotary disc and a rotary cone. The disc and cone form a crushing zone between them. The rotary disc rotates about a horizontal axis and the rotary cone rotates about a horizontal axis which intersects the rotary disc at its center. Preferably, the rotary cone forms an angle of from 40 to 80 degrees with the vertical working surface of the rotary disc. As a result of such arrangement the crushing zone is of rectangular shape.

5 Claims, 3 Drawing Figures

DISC CRUSHER

This invention relates to a disc crusher for breaking non-metallic materials.

Genev U.S. Pat. No. 4,199,113 disclosed a well-known disc crusher consisting of a housing mounted on a supporting frame enclosed by a cover on top, a horizontal rotary disc being mounted on the housing, and a rotary cone being fitted inside it at an angle. The rotary disc and the rotary cone are driven by their own driving units, the rotary cone cooperating with the rotary disc to form a crushing zone. A feeding pipe is fitted in the disc crusher cover, and under it in the housing there is an upper blade fitted above the rotary disc in the plane of the crushing zone. A cleaning blade and a discharge tube are fitted under the rotary disc.

The disadvantages of the above-described known crusher are the following: The cleaning blades above and under the rotary disc make the design of the apparatus complicated. Such cleaning blades participate in the crushing process and set up irregular movements of the materials fed to the crushing zone and discharged therefrom. As a result the production of uniformly crushed materials by such apparatus cannot be guaranteed.

The present invention has among its objects the provision of a disc crusher of a simplified design which guarantees a regulated control of the crushed materials.

In accordance with the invention there is provided a disc crusher having a housing fitted under a supporting frame enclosed by a cover on top. In the housing there is fitted a vertically oriented rotary disc and a rotary casing fitted at an angle to it in a horizontal plane, the axis of the casing intersecting the operating plane of the rotary disc at its center. The rotary cone forms an angle from 40 to 80 degrees with the plane of the rotary disc, thus forming a crushing zone of rectangular shape. A feed pipe is mounted in the cover of the housing oriented just about the crushing zone, the discharge tube being mounted under the crushing zone.

The advantages of the disc crusher in accordance with the invention are as follows: A simplified enabling the direct falling of the material in the crushing zone; a crushing zone having a fixed shape guaranteeing even sizes of the crushed materials.

A preferred embodiment of the disc crusher of the invention is shown in the accompanying drawings, wherein.

Figure 1:
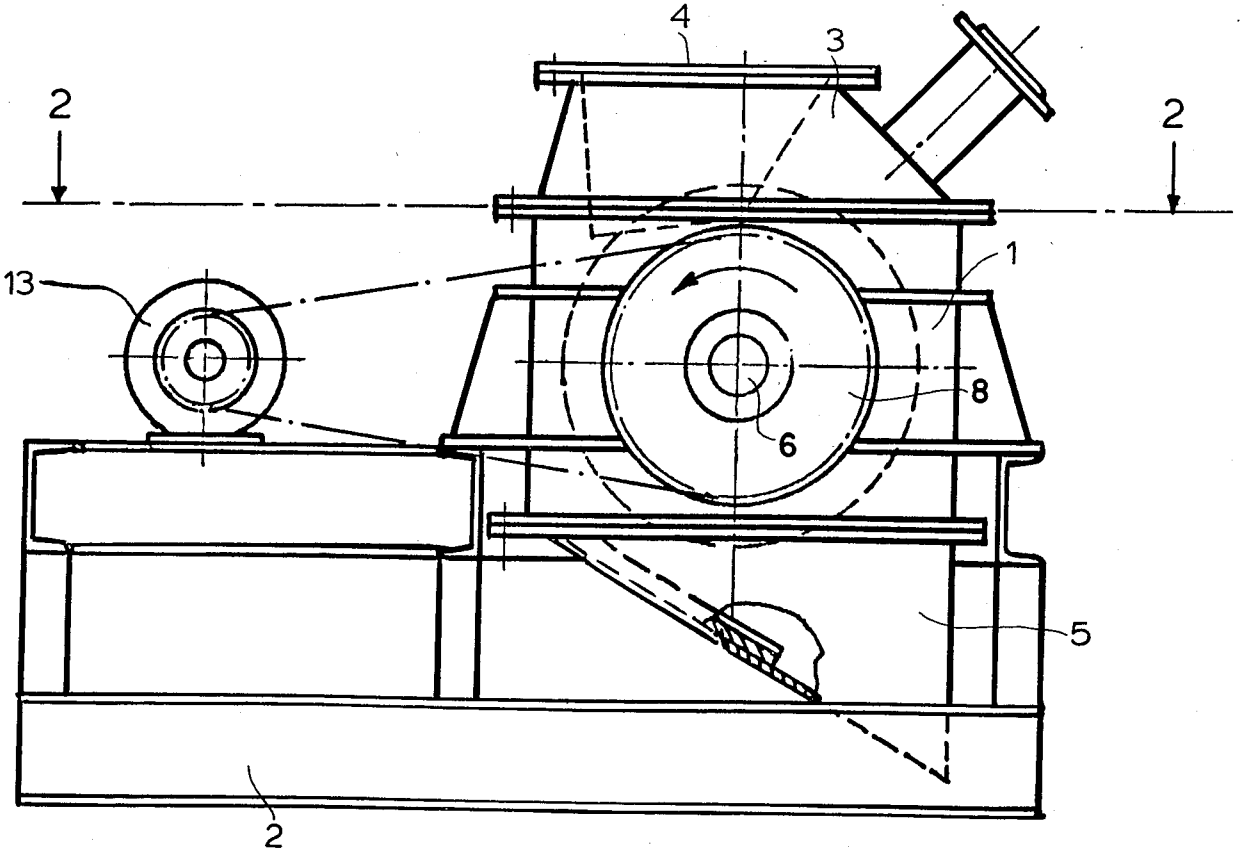
FIG. 1 is a view in side elevation of the disc crusher.
Figure 2:
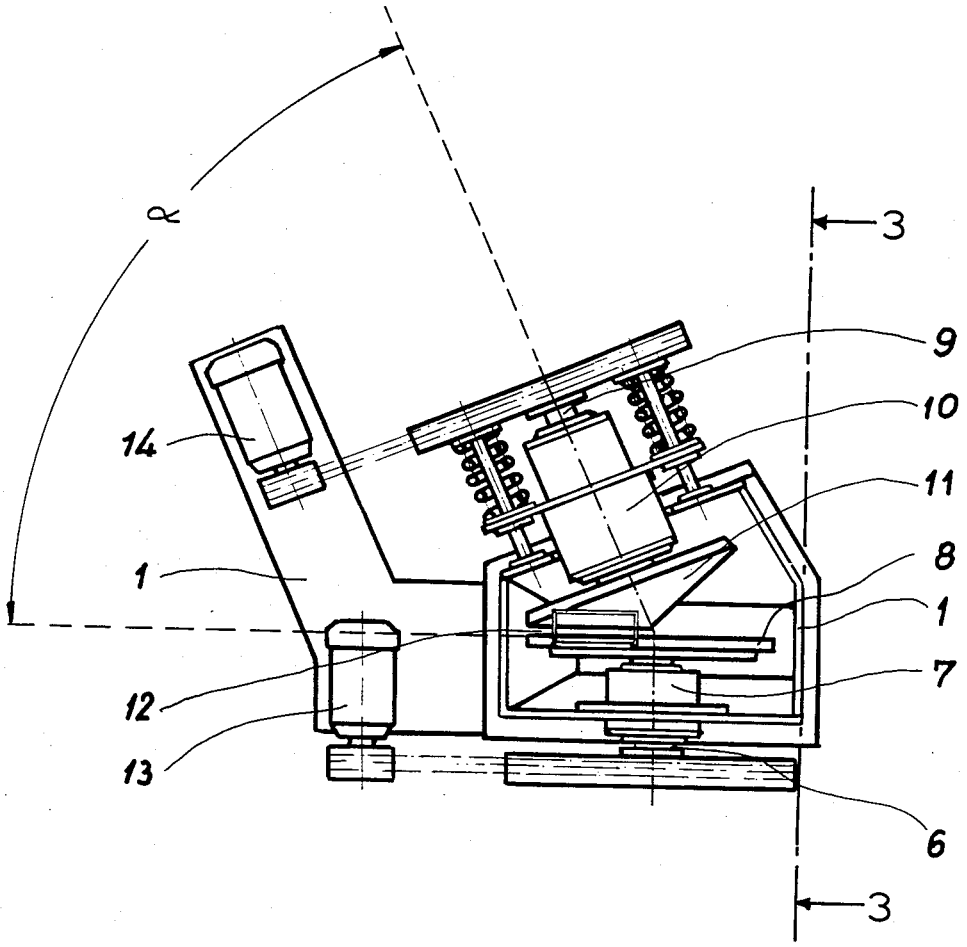
FIG. 2 is a view in sectional plan of the disc crusher shown in FIG. 1, the view being take from the line 2—2 in FIG. 1.
Figure 3:
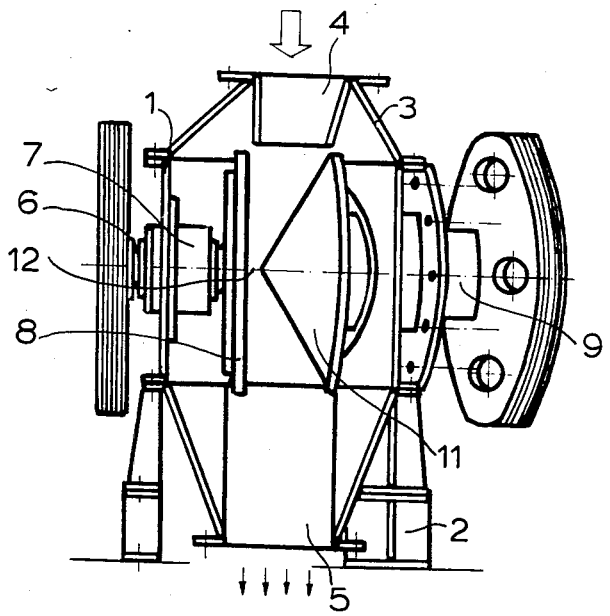
FIG. 3 is a view in vertical section through the disc crusher, the section being taken along line 3—3 in FIG. 2.

The disc crusher according to the invention has a housing 1 fitted on a supporting frame 2 and closed by a top cover 3. A discharge or outgoing tube 5 is mounted beneath the housing 1. In the housing 1 there is fitted horizontal shaft 6 with a vertically oriented disc 8 rotating in a bearing 7. On a horizontal shaft 9 there is mounted a rotary cone 11, shaft 9 rotating in a bearing 10. The axis of shaft 9 of rotary cone 11 intersects the operating plane of the rotary disc 8 in its center and forms an angle $\alpha$ of from 40 to 80 degrees with the plane of the disc 8.

The generator of the rotary cone 11 forms a rectangular crushing zone 12 with the operating face of a rotary disc 8. The drive of the rotary disc 8 and the drive of the rotary cone 11 is by means individual electric motors 13 and 14, respectively. The input tube 4 in cover 3 is oriented so as to be disposed directly over the crushing zone 12, and the outgoing or discharge tube 5 is fitted under the crushing zone 12.

The disc crusher according to the invention operates as follows: The material to be crushed is fed through the input tube 4 on cover 3 and falls directly into the crushing zone 12. Since such material is unable to deviate from the zone 12 it is crushed directly. The crushed material with the desired predetermined particle size falls beneath the crushing zone 12 and is taken out of the disc crusher through the discharge tube 5.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. In a disc crusher having a housing fitted on a supporting frame and closed by a cover bearing an input tube, within the housing there being fitted a rotary disc and a rotary cone, mounted upon and coaxial with respective first and second driving shafts, the disc and cone having working surfaces forming a crushing zone between them, the improvement wherein the rotary disc rotates about a first axis coincident with the axis of the first shaft and the rotary cone rotates about a second axis coincident with the axis of the second shaft, the second shaft axis intersecting the rotary disc at its center, the first and second shafts being horizontal.

2. A disc crusher according to claim 1, wherein the crushing zone is of rectangular shape.

3. A disc crusher according to claim 1, wherein the axis of the rotary cone forms an angle of from 40 to 80 degrees with the vertical working surface of the rotary disc.

4. A disc crusher according to claim 3, wherein the crushing zone is of rectangular shape.

5. A disc crusher according to claim 1, wherein the axes of the first and second shafts lie in the same plane.

* * * * *